US007901218B2

(12) United States Patent
Sato et al.

(10) Patent No.: US 7,901,218 B2
(45) Date of Patent: Mar. 8, 2011

(54) RECEPTACLE AND A PLUG WITH FIXTURES TO ATTACH TO SUBSTRATES AND ENGAGING EACH OTHER TO FORM A POWER SUPPLY CONTACT

(75) Inventors: Kazuhiro Sato, Tokyo (JP); Hiromichi Kato, Tokyo (JP); Hirokazu Takahashi, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/714,365

(22) Filed: Feb. 26, 2010

(65) Prior Publication Data

US 2010/0221928 A1 Sep. 2, 2010

(30) Foreign Application Priority Data

Feb. 27, 2009 (JP) ..... 2009-044980

(51) Int. Cl.
*H01R 12/00* (2006.01)

(52) U.S. Cl. ..... 439/74

(58) Field of Classification Search ..... 439/74, 439/65, 570, 108

See application file for complete search history.

(56) References Cited

U.S. PATENT DOCUMENTS

| | | | | |
|---|---|---|---|---|
| 5,904,581 | A | 5/1999 | Pope et al. | |
| 5,961,347 | A * | 10/1999 | Hsu | 439/570 |
| 6,659,808 | B2 * | 12/2003 | Billman et al. | 439/680 |
| 7,112,091 | B2 * | 9/2006 | Okura et al. | 439/570 |
| 7,374,432 | B2 | 5/2008 | Koguchi et al. | |
| 7,465,195 | B1 * | 12/2008 | Kerrigan et al. | 439/607.05 |
| 7,585,185 | B2 * | 9/2009 | Obikane | 439/607.01 |
| 2003/0219999 | A1 | 11/2003 | Minich et al. | |
| 2004/0014335 | A1 * | 1/2004 | Igarashi et al. | 439/74 |
| 2004/0161954 | A1 * | 8/2004 | Johnescu et al. | 439/74 |
| 2006/0276061 | A1 | 12/2006 | Koguchi | |
| 2007/0010110 | A1 * | 1/2007 | Ono et al. | 439/74 |
| 2007/0207680 | A1 | 9/2007 | Chen et al. | |

FOREIGN PATENT DOCUMENTS

| | | | |
|---|---|---|---|
| EP | 1 950 839 | A1 | 7/2008 |
| EP | 1 962 383 | A2 | 8/2008 |
| JP | 5 069873 | U | 9/1993 |
| JP | 7 016381 | U | 3/1995 |
| JP | 2007-018785 | | 1/2007 |
| WO | WO 89/02166 | A1 | 3/1989 |
| WO | WO 2006/081439 | A1 | 8/2006 |

OTHER PUBLICATIONS

Extended Search Report, dated Jun. 18, 2010, issued in corresponding European Patent Application No. 10154482.3.

* cited by examiner

*Primary Examiner* — Chandrika Prasad
(74) *Attorney, Agent, or Firm* — Klarquist Sparkman, LLP

(57) ABSTRACT

An electrical connector includes a receptacle connector and a plug connector. A first fixture and a second fixture are each arranged on at least one end in the longitudinal direction of the receptacle and plug connectors, respectively. The first and second fixtures each have connection portions to be connected to a respective substrate. The first and second fixtures include at least three engaging portions and at least three anchoring portions, respectively. The engaging portions and anchoring portions are adapted to engage each other. At least one set of the engaging and anchoring portions engaged each other is caused to be in electrical continuity to use as a power supply connection. The electrical connector thus constructed is capable of sufficiently withstand any accidental external force when being fitted, and is also capable of ensuring a power supply connection without using many terminals, while keeping narrower pitches of conductors, and miniaturization and reduced overall height of the electrical connector.

5 Claims, 6 Drawing Sheets

RECEPTACLE AND A PLUG WITH FIXTURES TO ATTACH TO SUBSTRATES AND ENGAGING EACH OTHER TO FORM A POWER SUPPLY CONTACT

CROSS REFERENCE TO RELATED APPLICATION

This application claims priority to and the benefit of Japan Patent Application No. 2009-44980, filed on Feb. 27, 2009, in the Japan Patent Office, the disclosure of which is incorporated herein by reference in its entirety.

BACKGROUND OF THE INVENTION

This invention relates to electrical connectors for use with electric and electronic appliances such as cell-phones, small type personal computers, and the like, and more particularly to an electrical connector capable of sufficiently holding electrical connections even if being subjected to accidental forces and having fixtures which can also be used as power supply contacts other than their inherent function.

In general, when substrates are interconnected, it is usual to use two connectors each having the respective substrate connected thereto by soldering or the like. The two connectors can be coupled to each other.

As examples of such connectors for connecting substrates proposed by the applicant of the present application, incorporated by reference herein are Japanese Utility Model Application Laid Open No. H05-69,873 (1993) (Patent Literature No. 1), Japanese Utility Model Application Laid Open No. H07-16,381 (1995) (Patent Literature No. 2), and Japanese Patent Application Laid Open No. 2007-18,785 (U.S. Pat. No. 7,374,432 Patent Literature No. 3).

The Japanese Utility Model Application Laid Open No. H05-69,873 (Patent Literature No. 1) discloses a connector for avoiding obliquely mis-insertion of a mating connector. For realizing such an object, two square rod shaped coupling members of different sizes are used for the pair of coupling connectors. By this, such a mis-insertion can be avoided.

The Japanese Utility Model Application Laid Open No. H07-16,381 (Patent Literature No. 2) discloses a connector realizing a definite locking force and giving a clear indication of the completion of an electric coupling with a short coupling length by providing a protrusion on a male contact and a recess on a mating female contact. The indication is given by a click tone at the coupling.

The Patent Application Laid Open No. 2007-18,785 (U.S. Pat. No. 7,374,432) (Patent Literature No. 3) discloses a connector having a floating coupling feature with a simple construction using a special crank shaped contact.

Recently, there are increasing demands from customers for narrower pitches of contacts, and for miniaturization and reduced overall height of connectors. Moreover, there has been a requirement for improvement in the toughness of connectors against accidental forces experienced when connectors between substrates are being fitted with each other. In the case of existing connectors between substrates, a rated current of a unit contact is of the order of 0.4 A. However, it is often required to convey power having a current of an order of 1 A. In such a case, it is unavoidable to use multiple terminals (contacts) for power supply purposes.

With the constructions as disclosed in the above Patent Literatures, although they comply with the requirements for narrower pitches of conductors and miniaturization and reduced overall height of connectors, they do not satisfy the need to improve toughness against accidental forces in handling and do not conduct a current of the order of 1 A without using plural terminals for each current supply unit.

SUMMARY OF THE INVENTION

In view of the problems with the prior art described above, this invention has been realized. The invention has an object to provide an electrical connector which complies with requirements for narrower pitches of conductors, for miniaturization, and for reduced overall height of the connector. The connectors are capable of sufficiently holding electrical connections with excellent durability against accidental forces when being fitted together and are also capable of providing power supply connections without using a plural number of terminals.

The object of the invention can be accomplished by the electrical connector as stated in claim 1 for connecting substrates. The connector includes a plug connector and a receptacle connector to be detachably fitted with each other. The receptacle connector includes a plurality of receptacle contacts and a block for arranging and holding said receptacle contacts. The receptacle contacts each have a first contact portion adapted to contact a mating contact, a first fixed portion to be fixed to said block, and a first connection portion to be connected to one of said substrates. The plug connector includes a plurality of plug contacts and a housing for arranging and holding said plug contacts. The plug contacts each have a second contact portion adapted to contact said receptacle contact, a second fixed portion to be fixed to said housing, and a second connection portion to be connected to the other of said substrates. Said plug connector and said receptacle connector are provided with a first fixture and a second fixture each arranged on at least one end in the longitudinal direction of the respective connector. Said first fixture and said second fixture each have connection portions to be connected to said substrate of the respective connector. One of said first and second fixtures is provided with at least three engaging portions, and the other of said fixtures is provided with at least three anchoring portions, respectively. Said engaging portions and said anchoring portions are adapted to engage each other. At least one set of said engaging and anchoring portions engaged with each other is caused to be in electrical continuity, thereby providing power supply contacts.

The electrical connector claimed in claim 2 is constructed such that said engaging portions and said anchoring portions are provided at three locations on said first and second fixtures at the center and at both ends in the width direction of the first and second fixtures, respectively.

The electrical connector claimed in claim 3 is constructed such that said first fixture is substantially in the form of a plate-shaped piece and comprises, as said engaging portions, second engaging portions on both sides projecting into the width directions of said first fixture. A first engaging portion projects into a fitting opening of said connector and is located on an elastic piece formed by folding back a part of said first fixture at the center in the width direction of said first fixture. Said second fixture is substantially in the form of an inverted U-shape. The second fixture comprises, as said anchoring portions, second anchoring portions corresponding to said second engaging portions, and is located on plate-shaped pieces folded back into substantially U-shapes on both ends in the width direction of said second fixture. A first anchoring portion is formed by folding back a part of said second fixture at the center in the width direction of said second fixture.

The electrical connector claimed in claim 4 is constructed such that the first engaging portion of said first fixture is formed as a protrusion, and said second engaging portions are formed as projecting portions projecting outwardly. The first anchoring portion of said second fixture is formed as a plate-shaped portion having a substantially U-shaped cross-section adapted to engage said protrusion, and said second anchoring portions are formed as recesses adapted to accommodate said projecting portions, respectively.

The electrical connector claimed in claim 5 is constructed such that the first engaging portion of said first fixture and the second anchoring portions of said second fixture each have an elasticity.

As can be seen from the above descriptions, the electrical connector according to the invention can provide the following significant functions and effects:

(1) The electrical connector for connecting substrates includes a plug connector and a receptacle connector to be detachably fitted with each other. Said receptacle connector includes a plurality of receptacle contacts and a block for arranging and holding said receptacle contacts. Said receptacle contacts each have a first contact portion adapted to contact a mating contact, a first fixed portion to be fixed to said block, and a first connection portion to be connected to one of said substrates. Said plug connector includes a plurality of plug contacts and a housing for arranging and holding said plug contacts. Said plug contacts each have a second contact portion adapted to contact said receptacle contact, a second fixed portion to be fixed to said housing. A second connection portion to be connected to the other of said substrates claimed in claim 1 is constructed such that said plug connector and said receptacle connectors are provided with a first fixture and a second fixture each arranged on at least one end in the longitudinal direction of the respective connector. Said first fixture and said second fixture each have connection portions to be connected to said substrate of the respective connector. One of said first and second fixtures is provided with at least three engaging portions, and the other of said fixtures is provided with at least three anchoring portions, respectively. Said engaging portions and said anchoring portions are adapted to engage each other, and at least one set of said engaging and anchoring portions engaged with each other is caused to be in electrical continuity, thereby using them as power supply contacts. Therefore, the electrical connector according to the invention can achieve narrower pitches of conductors and miniaturization and reduced overall height of the connector, and can ensure stable electrical connections because of engagements of the fixtures at three locations even while being subjected to accidental forces when being fitted. The electrical connector can provide a stable power supply connection by causing at least one set of the engaging portion of the fixtures to be in electrical continuity without using a number of terminals.

(2) The electrical connector claimed in claim 2 is constructed such that said engaging portions and said anchoring portions are provided at three locations on said first and second fixtures at the center and at both ends in the width direction of the first and second fixtures, respectively. Accordingly, the electrical connector according to the invention claimed in claim 2 can achieve narrower pitches of conductors and miniaturization and reduced overall height of the connector, and can ensure stable electrical connections because of engagements of the fixtures at three locations even if being subjected to accidental forces when being fitted. The electrical connector can utilize a stable power supply connector by causing at least one set of the engaging portion of the fixtures to be in electrical continuity without using a number of terminals. Since the first engaging portions and the first anchoring portions of the first and second fixtures are located substantially at the center in the width direction of the fixture or the connectors, even if accidental forces acting on the connectors in the longitudinal direction are increased, the engagements of these engaging and anchoring portions do not disengage. Thus, such a rigid engagement portion is caused to be in electrical continuity, thereby enabling the engagement portion to be used as a power supply unit. Further, since the second engaging portions and the second anchoring portions of the first and second fixtures are located substantially on both ends in the width direction of the fixtures or the connectors, even if accidental forces acting on the connectors in the width direction are increased, the engagements of these engaging and anchoring portions do not disengage. Thus, such a rigid engagement portion is caused to be in electrical continuity, thereby enabling the engagement portion to be used as a power supply unit.

(3) The electrical connector claimed in claim 3 is constructed such that said first fixture is substantially in the form of a plate-shaped piece. The first fixture comprises, as said engaging portions, second engaging portions on both sides projecting into width directions of said first fixture. A first engaging portion projects into a fitting opening of said connector and is located on an elastic piece formed by folding back a part of said first fixture at the center in the width direction of said first fixture, and that said second fixture is substantially in the form of an inverted U-shape. The second fixture comprises, as said anchoring portions, second anchoring portions corresponding to said second engaging portions and located on plate-shaped pieces folded back into substantially U-shapes on both ends in the width direction of said second fixture. A first anchoring portion is formed by folding back a part of said second fixture at the center in the width direction of said second fixture. Consequently, the electrical connector according to the invention claimed in claim 3 can achieve narrower pitches of conductors and miniaturization and reduced overall height of the connector, and can ensure stable electrical connections because of engagements of the fixtures at three locations even if being subjected to accidental forces when being fitted. The electrical connector can provide a stable power supply connection by causing at least one set of the engaging portion of the fixtures to be in electrical continuity without using a number of terminals. Since the first engaging portions and the first anchoring portions of the first and second fixtures are located substantially at the center in the width direction of the fixtures or the connectors, even if accidental forces acting on the connectors in the longitudinal direction are increased, the engagements of these engaging and anchoring portions do not disengage. Thus, such a rigid engagement portion is caused to be in electrical continuity, thereby enabling the engagement portion to be used also as a power supply connector. Further, since the second engaging portions and the second anchoring portions of the first and second fixtures are located substantially on both ends in the width direction of the fixtures or the connectors, even if accidental forces acting on the connectors in the width direction are increased, the engagements of these engaging and anchoring portions do not disengage. Thus, such a rigid engagement portion is caused to be in electrical continuity, thereby enabling the engagement portion to be used as a power supply connector.

(4) The electrical connector claimed in claim 4 is constructed such that the first engaging portion of said first fixture is formed as a protrusion. Said second engaging portions are formed as projecting portions projecting outwardly. The first anchoring portion of said second fixture is formed as a plate-shaped portion having a substantially U-shaped cross-section adapted to engage said protrusion. Said second anchoring portions are formed as recesses adapted to accommodate said projecting portions, respectively. Accordingly, the electrical connector according to the invention claimed in claim 4 can achieve narrower pitches of conductors and miniaturization and reduced overall height of the connector, and can ensure stable electrical connections because of engagements of the fixtures at three locations even if being subjected to accidental forces when being fitted. The electrical connector can also provide a stable power supply connection by causing at least one set of the engaging portion of the fixtures to be in electrical continuity without using a number of terminals and contacts. Since the first engaging portions and the first anchoring portions of the first and second fixtures are located substantially at the center in the width direction of the fixtures or the connectors, even if accidental forces acting on the connectors in the longitudinal direction are increased, the engagements of these engaging and anchoring portions do not disengage. Thus, such a rigid engagement portion is caused to be in electrical continuity, thereby enabling the engagement portion to be used as a power supply connector. Further, since the second engaging portions and the second anchoring portions of the first and second fixtures are located substantially on both ends in the width direction of the fixtures or the connectors, even if accidental forces acting on the connectors in the width direction are increased, the engagements of these engaging and anchoring portions do not disengage. Thus, such a rigid engagement portion is caused to be in electrical continuity, thereby enabling the engagement portion to be used as a power supply connector as well.

(5) The electrical connector claimed in claim 5 is constructed such that the first engaging portion of said first fixture and the second anchoring portions of said second fixtures each have an elasticity. Therefore, the electrical connector according to the invention claimed in claim 5 can achieve narrower pitches of conductors and miniaturization and reduced overall height of the connector, and can ensure stable electrical connections because of engagements of the fixtures at three locations even if being subjected to accidental forces when being fitted. The electrical connector can be utilized as a stable power supply connector by causing at least one set of the engaging portion of the fixtures to be in electrical continuity without using a number of terminals or contacts. Since the first engaging portions and the first anchoring portions of the first and second fixtures are located substantially at the center in the width direction of the fixtures or the connectors, even if accidental forces acting on the connectors in the longitudinal direction are increased, the engagements of these engaging and anchoring portions do not disengage. Thus, such a rigid engagement portion is caused to be in electrical continuity, thereby enabling the engagement portion to be used as a power supply connector. Further, since the second engaging portions and the second anchoring portions of the first and second fixtures are located substantially on both ends in the width direction of the fixtures or the connectors, even if accidental forces acting on the connectors in the width direction are increased, the engagements of these engaging and anchoring portions do not disengage, and such a rigid engagement portion is caused to be in electrical continuity, thereby enabling the engagement portion to be used as a power supply connector.

The invention will be more fully understood by referring to the following detailed specification and claims taken in connection with the appended drawings.

DESCRIPTION OF THE PREFERRED EMBODIMENT

Figure 1A:
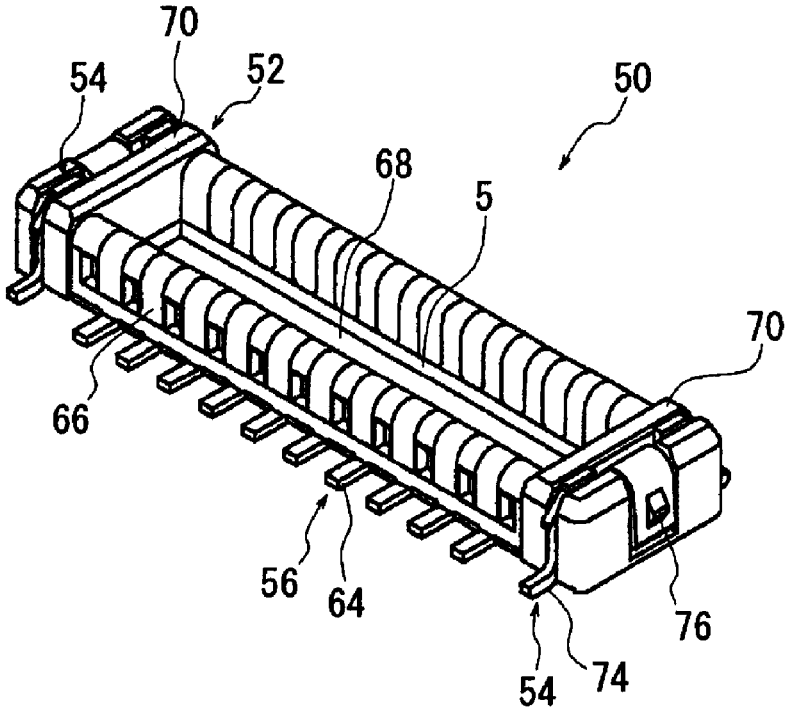
FIG. 1A is a perspective view of a plug connector viewed from its fitting opening.

The subject features of the invention lie in an electrical connector 10 for connecting substrates, including a receptacle connector 20 and a plug connector 50 to be detachably fitted with each other. Said receptacle connector 20 includes a plurality of receptacle contacts 24 and a block 22 for arranging and holding said receptacle contacts 24. Said receptacle contacts 24 each have a first contact portion 26 adapted to contact a mating contact, a first fixed portion 28 to be fixed to the block 22, and a first connection portion 30 to be connected to one of the substrates. Said plug connector 50 includes a plurality of plug contacts 56 and a housing 52 for arranging and holding said plug contacts 56. Said plug contacts 56 each have a second contact portion 58 adapted to contact said receptacle contact 24, a second fixed portion 60 to be fixed to said housing 52, and a second connection portion 64 to be connected to the other of the substrates. The receptacle and plug connectors 20 and 50 are provided with a first fixture 54 and a second fixture 25, respectively, each arranged on at least one end in the longitudinal direction of the respective connector. Each has connection portions 74, 44 to be connected to the substrate of the connector. Said first and second fixtures are provided with at least three engaging portions 76 and 77 and at least three anchoring portions 46 and 48, respectively. Said engaging portions 76 and 77 and said anchoring portions 46 and 48 are adapted to engage each other. At least one set of said engaging and anchoring portions engaged each other is caused to be in electrical continuity, thereby using it as a power supply contact.

In other words, said first fixture 54 and said second fixture 25 are arranged on at least one ends in the longitudinal direction of the receptacle and plug connectors 20 and 50, respectively, so that the respective fixtures 54 and 25 are locked (engaged) together at three locations and at least one locked portion is caused to be into electrical continuity, thereby using the locked portion as a power supply contact.

Figure 1B:
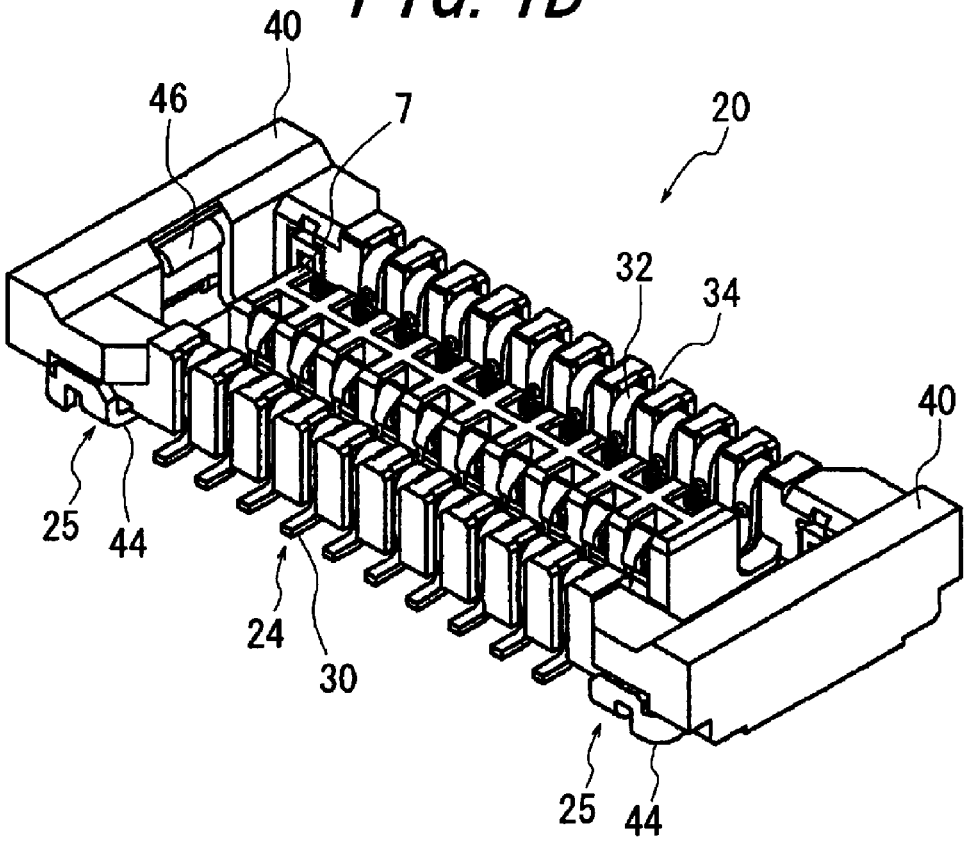
FIG. 1B is a perspective view of a receptacle connector viewed from its fitting portion.

One embodiment of the electrical connector according to the invention will be explained with reference to drawings. FIG. 1A is a perspective view of a plug connector viewed from its fitting opening, and FIG. 1B is a perspective view of a receptacle connector viewed from its fitting portion. FIG.

Figure 2A:
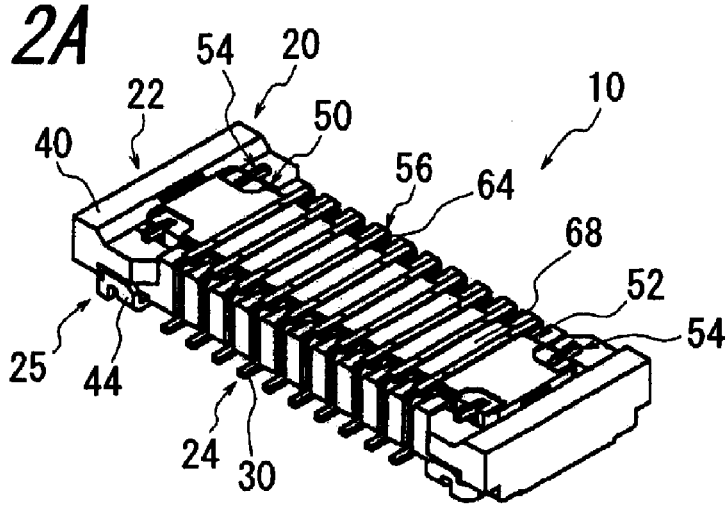
FIG. 2A is a perspective view of the plug and receptacle connectors fitted with each other.
Figure 2B:
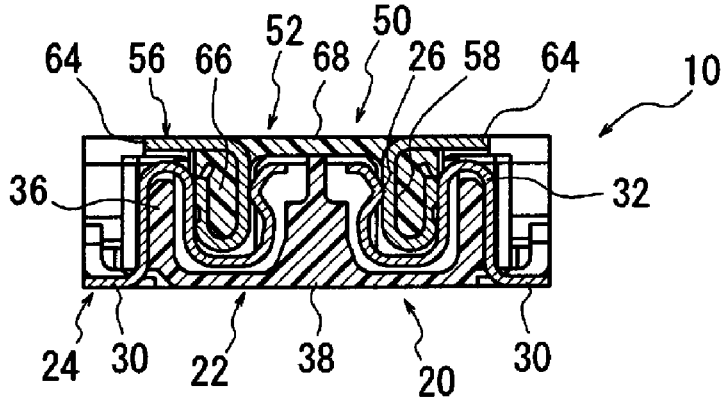
FIG. 2B is a cross-sectional view of the fitted plug and receptacle connectors taken along some contacts.
Figure 2C:
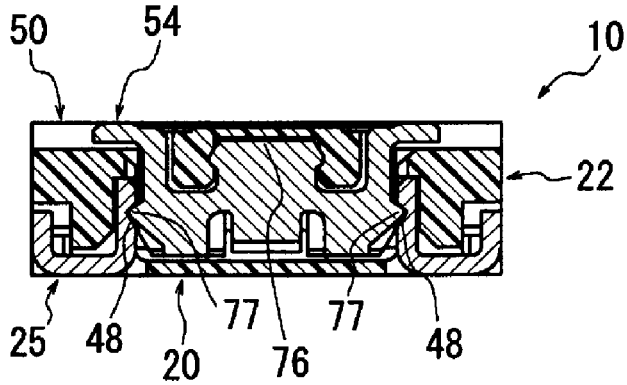
FIG. 2C is a cross-sectional view of the fitted plug and receptacle connectors taken along fixtures.
Figure 3A:
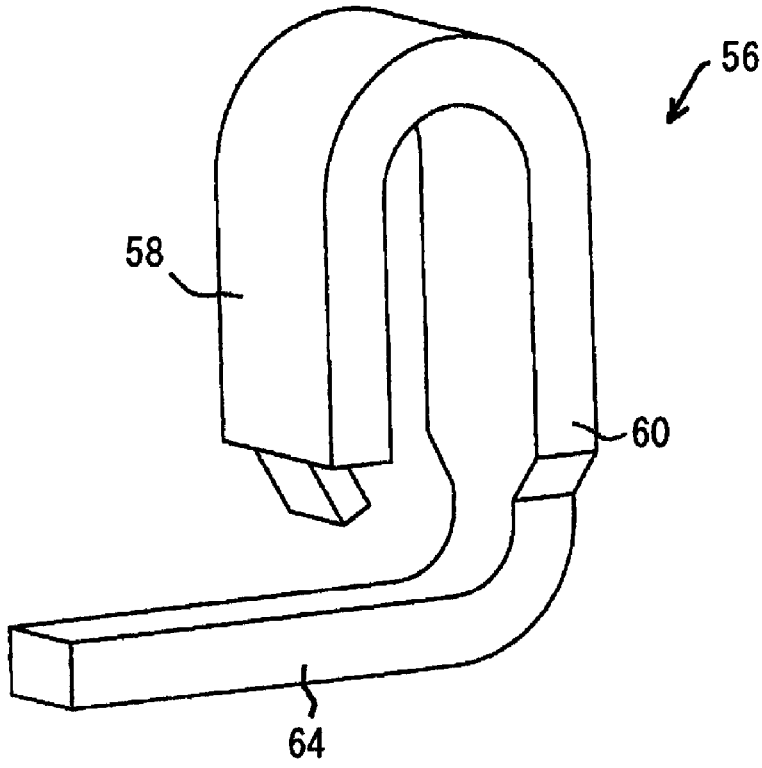
FIG. 3A is a perspective view of a plug contact.
Figure 3B:
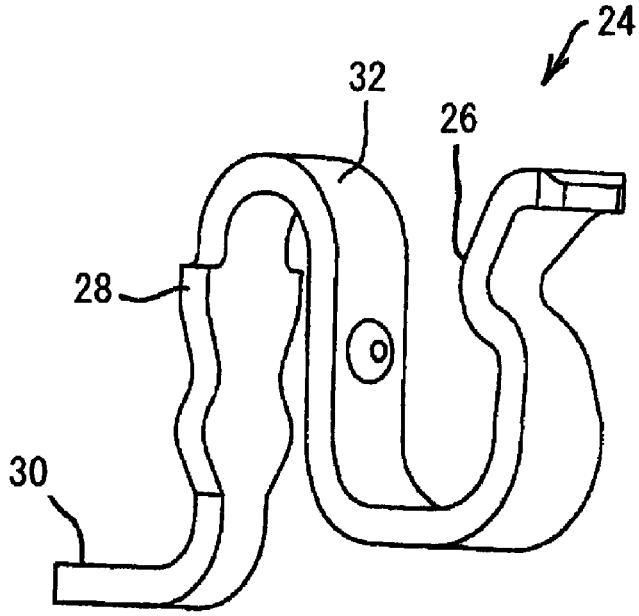
FIG. 3B is a perspective view of a receptacle contact.
Figure 4A:
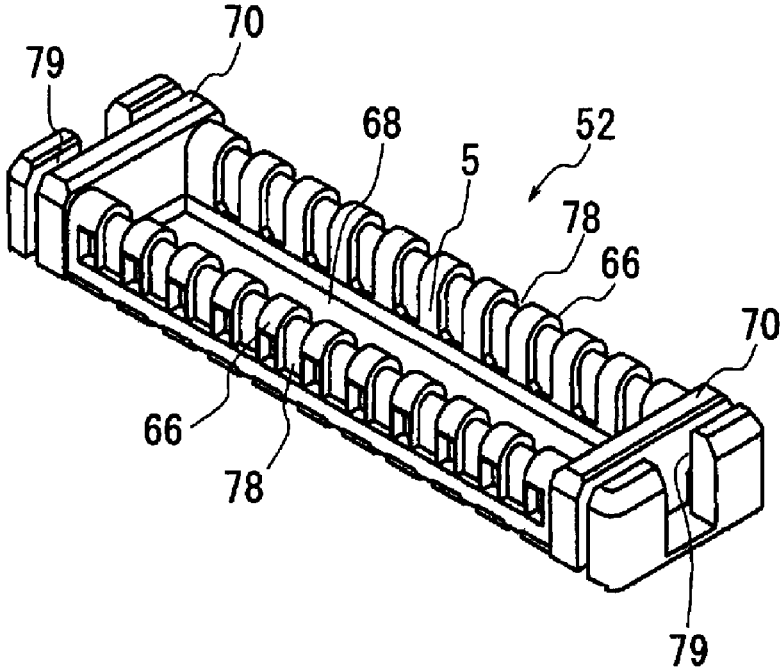
FIG. 4A is a perspective view of a housing of the plug connector.
Figure 4B:
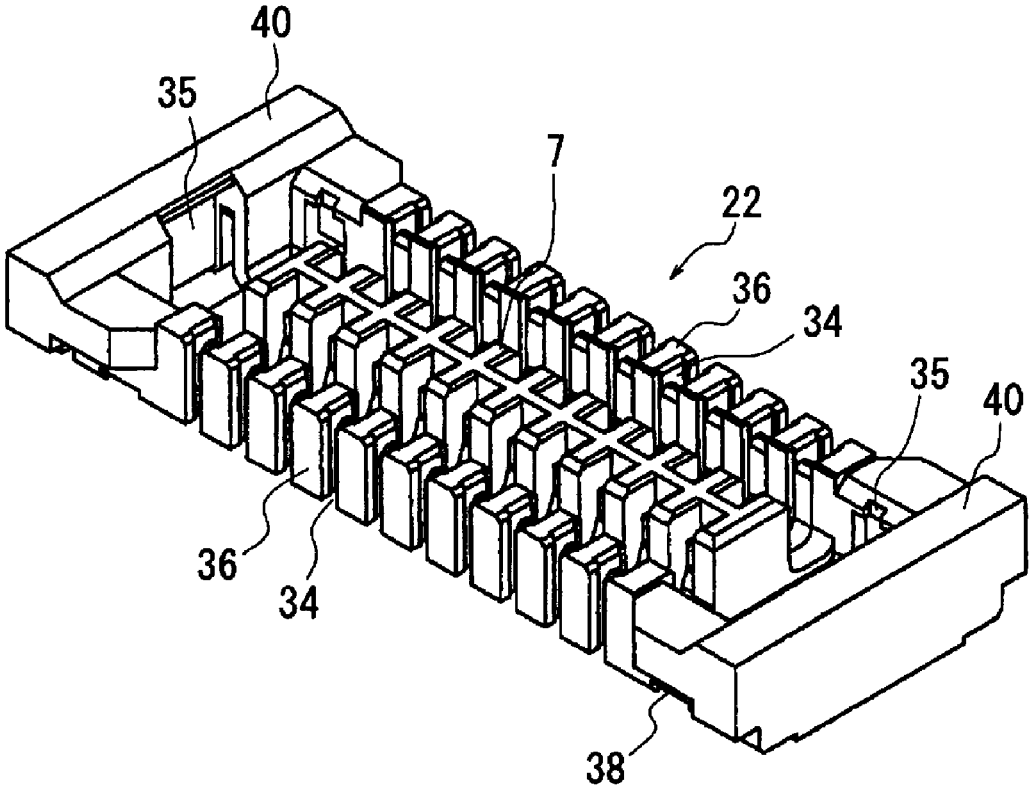
FIG. 4B is a perspective view of a block of the receptacle connector.
Figure 5A:
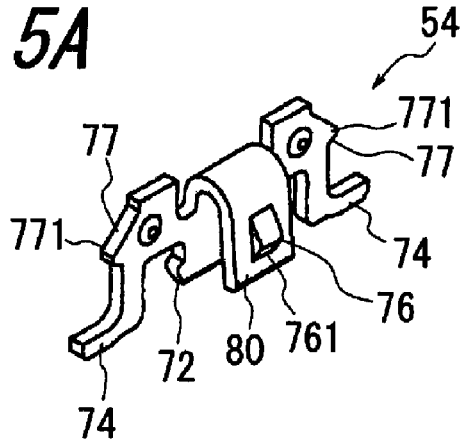
FIG. 5A is a perspective view of a first fixture.
Figure 5B:
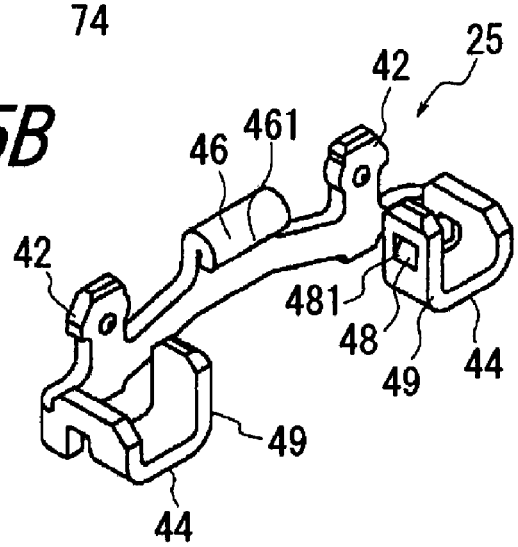
FIG. 5B is a perspective view of a second fixture.
Figure 5C:
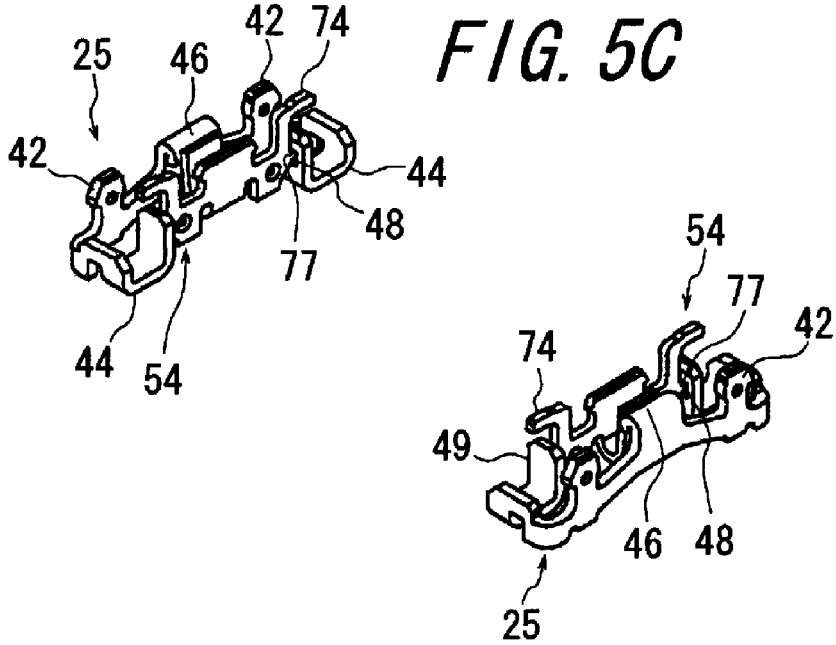
FIG. 5C is a perspective view of the first and second fixtures engaging each other at both ends in the longitudinal direction of the electrical connector.
Figure 6A:
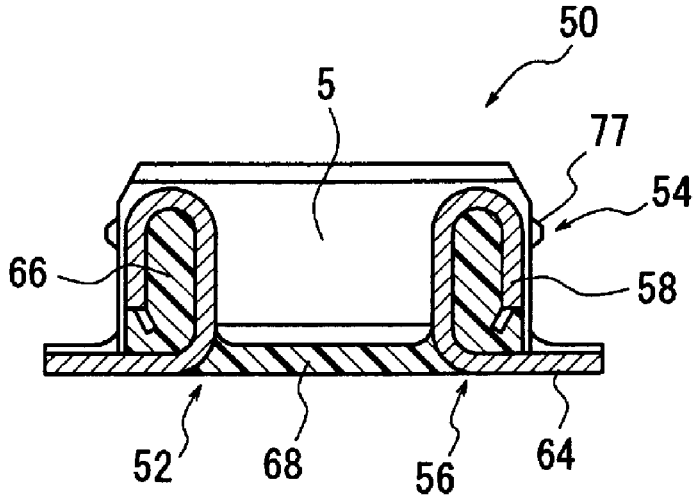
FIG. 6A is a cross-sectional view of the plug connector taken along plug contacts.
Figure 6B:
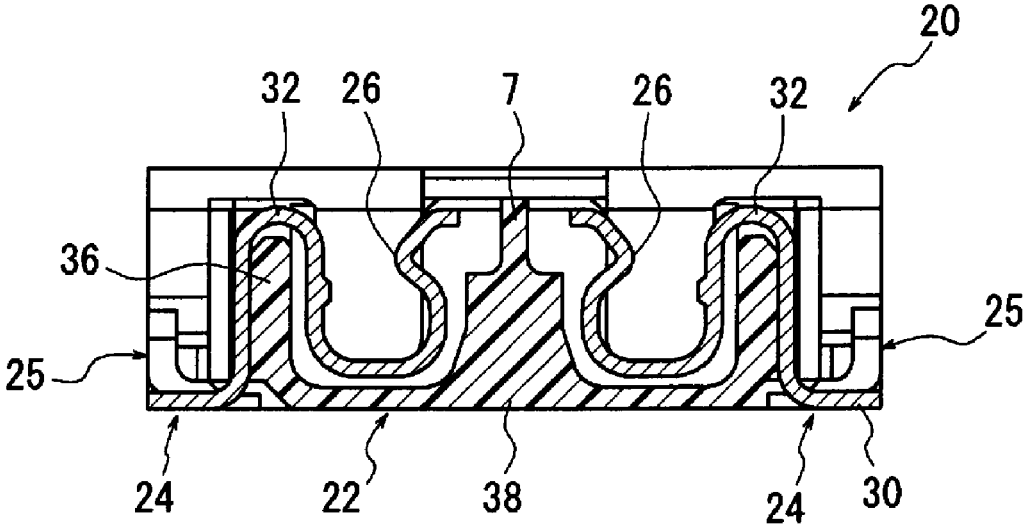
FIG. 6B is a cross-sectional view of the receptacle connector taken along receptacle contacts.

2A is a perspective view of the plug and receptacle connectors fitted with each other. FIG. 2B is a cross-sectional view of the fitted plug and receptacle connectors taken along some contacts. FIG. 2C is a cross-sectional view of the fitted plug and receptacle connectors taken along fixtures. FIG. 3A is a perspective view of a plug contact, and FIG. 3B is a perspective view of a receptacle contact. FIG. 4A is a perspective view of a housing of the plug connector, while FIG. 4B is a perspective view of a block of the receptacle connector. FIG. 5A is a perspective view of a first fixture, while FIG. 5B is a perspective view of a second fixture, and FIG. 5C is a perspective view of the first and second fixtures engaging each other at both ends in the longitudinal direction of the electrical connector. FIG. 6A is a cross-sectional view of the plug connector taken along plug contacts, while FIG. 6B is a cross-sectional view of the receptacle connector taken along receptacle contacts.

The electrical connector 10 according to the invention comprises a plug connector 50 and a receptacle connector 20. Each of the connectors 50 and 20 mainly comprises contacts 56, 24, a plastic insulator, and fixtures 54, 25.

First, the receptacle connector 20 will be explained. Said receptacle connector 20 mainly comprises a block 22, receptacle contacts 24, and second fixtures 25.

First, the receptacle contacts 24 will be explained. The receptacle contacts 24 are made of a metal and formed by means of the press-working of a known technique. Preferred metals from which to form the receptacle contacts 24 include brass, beryllium copper, phosphor bronze and the like which comply with the requirements as to springiness, electric conductivity, and the like. The receptacle contact 24 mainly comprises a first contact portion 26 adapted to contact a plug contact 56, a first fixed portion 28 to be fixed to said block 22, a first connection portion 30 to be connected to a substrate, and an elastic portion 32 located between said first contact portion 26 and said first fixed portion 28.

As shown in FIG. 3B, the respective portions of the receptacle contact 24 are located in the order of the first contact portion 26, the elastic portion 32, the first fixed portion 28, and the first connection portion 30. The respective portions will now be explained. First, the first contact portion 26 is adapted to contact the second contact portion 58 of a plug contact 56. Said first contact portion 26 is substantially in the form of a plate piece and is curved so that the first contact portions 26 contacts the second contact portion 58 of the plug contact 56 in a line contact at one location. The first contact portion 26 need only be able to contact the second contact portion 58 of said plug contact 56 and may be suitably designed in consideration of contact stability, space-saving and a reduced overall height of the electrical connector 10 upon being fitted, workability and the like.

Said elastic portion 32 is provided with at least one serpentine portion or tortuous portion in order to achieve a miniaturization of the connector and stable contact between the receptacle and plug contacts 24 and 56 by pushing said plug connector 50 with the contact pressure obtained by the elasticity of the elastic portion 32. In the illustrated embodiment, the elastic portion 32 of the receptacle contact 24 has one serpentine portion. The elastic portion 32 is positioned substantially at the upper portion of the block 22 corresponding to the height of the block 22. The number of serpentine portions may be arbitrary insofar as the plug connector 50 is pushed with the contact pressure to obtain the stable contact, and may be suitably designed taking into account the contact pressure, space-saving, and reduced overall height of the fitted electrical connector 10, workability, and the like. The radius of curvature of the serpentine portion of the elastic portion 32 may be suitably designed in consideration of the space-saving and reduced overall height of the fitted electrical connector 10, workability, and the like.

The first fixed portion 28 of the receptacle contact 24 is adapted to be held in a first inserting hole 34 of the block 22. In the illustrated embodiment, the first fixed portion is inserted into the first inserting hole 34 by press-fitting. However, any methods other than the press-fitting may be used so long as the receptacle contacts can be firmly held, and these methods may be selected in consideration of the miniaturization of the connector, strength, the holding force, and the like.

Said first connection portion 30 of the receptacle contact 24 is adapted to be connected to a substrate. The shape (or type) of the first connection portion 30 is a surface mounting type (SMT) in the illustrated embodiment, but the shape (type) is arbitrary so long as it can be connected to the substrate. For example, a dip type may be used.

Said block 22 will now be explained. Said block 22 comprises two first side walls 36, a first bottom wall 38, first flanges 40, and a fitting portion 7, and is substantially in the form of a hexahedron as a whole. Said block 22 is formed from an electrically insulating plastic material by means of the injection molding of a known technique. The materials for the block 22 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like and combinations thereof. The two first side walls 36 of the block 22 are formed with the first inserting holes 34 into which a required number of the receptacle contacts 24 are installed and fixed, respectively, by means of any one of press-fitting, hooking (lancing), welding, and the like. In the illustrated embodiment, the receptacle contacts 24 are fitted in the first inserting holes 34 by press-fitting.

The fitting portion 7 of said block 22 is formed to be surrounded by the two first side walls 36, the first bottom wall 38, and the first flanges 40 and is adapted to be fitted in a fitting opening 5 of said plug connector 50. Said fitting portion 7 need only be fitted in the fitting opening 5 of said plug connector 50 as a mating connector. The size and shape of the fitting portion 7 may be suitably designed so as to be commensurate with the plug connector and in consideration of the contact stability, miniaturization of the connector, workability, and the like.

Said first flanges 40 are each formed with a third insertion hole 35 into which the second fixture 25 is inserted and fixed by means of any one of press-fitting, hooking (lancing), welding, and the like. In the illustrated embodiment, the second fixtures 25 are fixed in the third insertion holes 35 by press-fitting.

The second fixtures 25 will then be explained, which form an important aspect of the invention. The second fixtures 25 are made of a metal and formed by means of the press-working of a known technique. Preferred metals from which to form the second fixtures 25 include brass, beryllium copper, phosphor bronze and the like which comply with the requirements as to springiness, electric conductivity, and the like. Said second fixture 25 mainly comprises first and second anchoring portions 46 and 48 positioned in at least three locations and adapted to engage the first fixture 54, third fixed portions 42 to be fixed to said block 22, and third connection portions 44 to be connected to the substrate.

Said second fixtures 25 are arranged at both ends in the longitudinal direction of the receptacle connector 20, respectively, to achieve balancing. Said second fixture 25 is substantially in the form of an inverted U-shape, and includes on both sides plate-shaped pieces 49. Each of the plate-shaped pieces 49 is substantially U-shaped by folding back that portion itself and is formed with the second anchoring portion 48 which corresponds to a second engaging portion 77 of the first fixture 54. The second fixture 25 further includes the first anchoring portion 46 formed by folding back that portion itself at the center of the width of the second fixture 25. The center of the width of the second fixture 25 substantially corresponds to the center of the width of the receptacle connector 20. The first anchoring portion 46 of the second fixture 25 is formed as a plate-shaped portion 461 having a U-shaped cross-section adapted to engage a protrusion 761 of the first fixture 54. Said second anchoring portions 48 are formed as recesses 481 for receiving projecting portions 771 of the first fixture 54, respectively. The second anchoring portions 48 of said second fixture 25 have an elasticity.

The shapes and sizes of said plate-shaped portion 461 (the first anchoring portion 46) and said recesses 481 (the second anchoring portions 48) may be any of various ones so long as they can engage the protrusion 761 (the first engaging portion 76) and the projecting portions 771 (the second engaging portions 77) of said first fixture 54, respectively, to obtain stable holding force and to achieve electrical continuity. They may be suitably designed taking into account the electrical continuity, workability, holding forces, miniaturization of the connector, and the like.

Said third fixed portions 42 are held in the third insertion holes 35 of said block 22. The third fixed portions 42 are inserted and held in the third insertion holes 35 by press-fitting in the illustrated embodiment. However, any methods other than press-fitting may be used insofar as the third fixed portions 42 can be firmly fixed. These methods may be suitably selected in consideration of the miniaturization of the connector, strength, holding forces, and the like.

Said third connection portions 44 are to be connected to the substrate. The shape (type) of the third connection portions may be any shape (type) insofar as they can be connected to the substrate. The surface mounting type (SMT) is employed for the third connection portions 44 in the illustrated embodiment, although, for example, a dip type may be used.

The plug connector 50 will then be explained. Said plug connector 50 mainly comprise a housing 52, plug contacts 56, and first fixtures 54.

The plug contacts 56 will now be explained. The plug contacts 56 are made of a metal and formed by means of the press-working of the known technique. Preferred metals from which to form the plug contacts 56 include brass, beryllium copper, phosphor bronze and the like which comply with the requirements as to springiness, electric conductivity, and the like. Said plug contact 56 mainly comprises a second contact portion 58 adapted to contact the receptacle contact 24, a second fixed portion 60 to be fixed to said housing 52, and a second connection portion 64 to be connected to a substrate.

As shown in FIG. 3A, the respective portions of the plug contact 56 are located in the order of the second contact portion 58, the second fixed portion 60, and the second connection portion 64. The respective portions will be explained hereinafter. First, the second contact portion 58 is adapted to contact the first contact portion 26 of the receptacle contact 24. The second contact portion 58 need only be able to contact the first contact portion 26 of said receptacle contact 24 and may be suitably designed in consideration of contact stability, space-saving, and a reduced overall height of the electrical connector 10 upon being fitted, workability, and the like. In the embodiment described, however, said second contact portion 58 may be provided in the flat portion of its substantially plate-shaped portion with a recess (not shown) in order to achieve stable removal force and click response which indicates a completion of the fitting. The shape and size of the recess may be suitably designed taking into account the functions described above, strength, contact stability, workability and the like.

Said second contact portion 58 of said plug contact 56 is formed in a manner that it is folded back outwardly of a second wall 66 of the housing 52. The result is that the second contact portion 58 becomes easy to contact said receptacle contact 24.

Said second fixed portion 60 of the plug contact 56 is adapted to be held in one of second inserting holes 78 of the housing 52. In the illustrated embodiment, the second fixed portion 60 is inserted and held in the second inserting hole 78 by press-fitting. However, any method other than the press-fitting may be used so long as the plug contact 56 can be firmly held, and these methods may be selected in consideration of the miniaturization of the connector, strength, the holding force, and the like.

Said second connection portion 64 of the plug contact 56 is to be connected to a substrate. The shape (or type) of the second connection portion 64 is a surface mounting type (SMT) in the illustrated embodiment, but the shape (type) is arbitrary so long as it can be connected to the substrate. For example, a dip type may be used.

Said housing 52 will then be explained. Said housing 52 is formed by the two second side walls 66, second flanges 70 and a second bottom wall 68 to form a substantial hexahedral shape. Said housing 52 is formed from an electrically insulating plastic material by means of the injection molding of the known technique. The materials for the housing 52 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like, and combinations thereof. The two second side walls 66 of the housing 52 are formed with second inserting holes 78 into which a required number of the plug contacts 56 are installed and fixed, respectively, by one method of press-fitting, hooking (lancing), welding, and the like. The shape and size of said second inserting holes 78 may be suitably designed taking into account the size and shape of said plug contacts 56, holding forces, and the like.

The two side walls 66, the second flanges 70, and the second bottom wall 68 form the fitting opening 5 into which the fitting portion 7 of said receptacle connector 20 is fitted. Said fitting opening 5 need only be fitted with the fitting portion 7 of said receptacle connector 20 as a mating connector. The size and shape of the fitting opening 5 may be suitably designed to be commensurate with said receptacle connector 20 and in consideration of contact stability, the miniaturization of the connector, workability, and the like.

The second flanges 70 are each formed with a fourth insertion hole 79 into which said first fixture 54 is fitted and fixed. The first fixtures 54 are fixed into the fourth insertion holes 79, respectively, by means of one of press-fitting, hooking (lancing), welding, and the like. The first fixtures 54 are fixed into the fourth insertion holes 79 by press-fitting in the illustrated embodiment.

The first fixtures 54 will now be explained, which form the important aspect of the invention. The first fixtures 54 are made of a metal and formed by means of the press-working of the known technique. Preferred metals from which to form the first fixtures 54 include brass, beryllium copper, phosphor bronze and the like which comply with the requirements as to springiness, electric conductivity, and the like. Said first fixture 54 mainly comprises at least three engaging portions 76 and 77 adapted to engage the three anchoring portions of the second fixture 25, respectively, fourth fixed portions 72 to be fixed to said housing 52, and fourth connection portions 74 to be fixed to the substrate.

Said first fixtures 54 are arranged at both the ends in the longitudinal direction of the plug connector 50, respectively, in view of balancing. Said first fixture 54 is substantially in the form of a plate-shaped piece, and includes the second engaging portions 77 projecting on both sides into the width directions of the plug connector 50. The first fixture 54 further includes at its center an elastic piece 80 formed by folding back that portion itself, the elastic piece 80 being provided with the first engaging portion 76 projecting into the fitting opening 5. The center of the width of the first fixture 54 substantially corresponds to the center of the width of the plug connector 50. The first engaging portion 76 of said first fixture 54 is formed as a protrusion 761, while the second engaging portions 76 are formed as projecting portions 771 outwardly projecting. The first engaging portion 76 of said first fixture 54 has an elasticity.

The shapes and sizes of said protrusion 761 (said first engaging portion 76) and said projecting portions 771 (said second engaging portions 77) may be any of various ones so long as they can engage the plate-shaped portion 461 (said first anchoring portion 46) and the recesses 481 (said second anchoring portions 48), respectively, to obtain stable holding force and to achieve electrical continuity. They may be suitably designed in consideration of the electrical continuity, workability, holding forces, miniaturization of the connector, and the like.

Said fourth fixed portions 72 of the first fixtures 54 are held in the fourth inserting holes 79 of said housing 52. The fourth fixed portions 72 are inserted and held in the fourth inserting holes 79 by press-fitting in the illustrated embodiment. However, any methods other than press-fitting may be used insofar as the fourth fixed portions 72 can be firmly fixed. These methods may be suitably selected in consideration of the miniaturization of the connector, strength, holding forces, and the like.

Said fourth connection portions 74 are to be connected to the substrate. The shape (type) of the fourth connection portions 74 may be any shape (type) so long as they can be connected to the substrate. The surface mounting type (SMT) is employed for the fourth connection portions 74 in the illustrated embodiment, although, for example, a dip type may be used.

Although the first fixtures 54 each having the engaging portions and the second fixtures 25 each having the anchoring portions are shown and explained in the embodiment, it is to be understood that the first fixtures 54 may be provided with anchoring portions and the second fixtures 25 may be provided with engaging portions.

Examples of applications of the present invention are electrical connectors for use with electric and electronic appliances such as cell-phones, small type personal computers, and the like, and more particularly electrical connectors capable of sufficiently withstanding accidental external forces and having the fixtures which are usable also as power supply contacts other than their inherent function of fixing the connectors.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector for connecting substrates, including a plug connector and a receptacle connector to be detachably fitted with each other, said receptacle connector including a plurality of receptacle contacts and a block for arranging and holding said receptacle contacts, said receptacle contacts each having a first contact portion adapted to contact a mating contact, a first fixed portion to be fixed to said block, and a first connection portion to be connected to one of said substrates, and said plug connector including a plurality of plug contacts and a housing for arranging and holding said plug contacts, said plug contacts each having a second contact portion adapted to contact said receptacle contact, a second fixed portion to be fixed to said housing, and a second connection portion to be connected to the other of said substrates, wherein said plug connector and said receptacle connector are provided with a first fixture and a second fixture each arranged on at least one end in the longitudinal direction of the respective connector, said first fixture and said second fixture each having connection portions to be connected to said substrate of the respective connector, wherein said first and second fixtures are provided with at least three engaging and/or anchoring portions being engaged each other, wherein at least one set of said engaging and/or anchoring portions engaged each other is caused to be in electrical continuity, thereby using it as power supply contacts wherein the second fixture direction is substantially in the form of an inverted U-shape and comprises a first anchoring portion formed by folding back a part of said second fixture at the center in the width of said second fixture.

2. The electrical connector as claimed in claim 1, wherein said engaging portions and/or said anchoring portions are provided at three locations on said first and second fixtures at the center and at both ends in the width direction of the first and second fixtures, respectively.

3. The electrical connector as claimed in claim 1, wherein:

said first fixture is substantially in the form of a plate-shaped piece and comprises, as said engaging portions, second engaging portions projecting on both sides into width directions of said first fixture, and a first engaging portion projecting into a fitting opening of said connector and located on an elastic piece formed by folding back a part of said first fixture at the center in the width direction of said first fixture, and said second fixture comprises, as said anchoring portions, second anchoring portions corresponding to said second engaging portions and located on plate-shaped pieces folded back into substantially U-shapes on both ends in the width direction of said second fixture.

4. The electrical connector as claimed in claim 3, wherein:

the first engaging portion of said first fixture is formed as a protrusion, and said second engaging portions are formed as projecting portions projecting outwardly, and the first anchoring portion of said second fixture is formed as a plate-shaped portion having a substantially U-shaped cross-section adapted to engage said protrusion, and said second anchoring portions are formed as recesses adapted to accommodate said projecting portions, respectively.

5. The electrical connector as claimed in claim 3, wherein the first engaging portion of said first fixture and the second anchoring portions of said second fixture each have an elasticity.

* * * * *